US009902472B2

(12) United States Patent
Wang et al.

(10) Patent No.: US 9,902,472 B2
(45) Date of Patent: Feb. 27, 2018

(54) SEMI-SUBMERSIBLE PLATFORM

(71) Applicant: Aker Solutions Inc., Houston, TX (US)

(72) Inventors: Tao Wang, Katy, TX (US); Xiaofeng Jiang, Houston, TX (US); Renjian Roger Lu, Houston, TX (US); Rolf Eide, Houston, TX (US); Henrik Hannus, Hovik (NO)

(73) Assignee: AKER SOLUTIONS INC., Houston, TX (US)

( * ) Notice: Subject to any disclaimer, the term of this patent is extended or adjusted under 35 U.S.C. 154(b) by 0 days.

(21) Appl. No.: 15/383,732

(22) Filed: Dec. 19, 2016

(65) Prior Publication Data

US 2017/0174296 A1 Jun. 22, 2017

Related U.S. Application Data

(60) Provisional application No. 62/269,641, filed on Dec. 18, 2015.

(51) Int. Cl.
*B63B 35/38* (2006.01)
*B63B 35/44* (2006.01)
(Continued)

(52) U.S. Cl.
CPC ..... *B63B 35/38* (2013.01); *B63B 35/4413* (2013.01); *B63B 43/06* (2013.01);
(Continued)

(58) Field of Classification Search
CPC ..... B63B 1/10; B63B 1/107; B63B 35/44; B63B 39/03; B63B 43/06; B63B 43/08; F17D 3/00
(Continued)

(56) References Cited

U.S. PATENT DOCUMENTS 9,205,897 B2 12/2015 Wang
9,566,650 B2 3/2017 Ye et al.
(Continued)

FOREIGN PATENT DOCUMENTS

WO 9912807 A1 3/1999
WO 0228704 A1 4/2002

OTHER PUBLICATIONS

International Search Report and Written Opinion issued in Application No. PCT/US2016/067552, dated Mar. 30, 2017, 16 pages.

*Primary Examiner* — Lars A Olson
(74) *Attorney, Agent, or Firm* — Rothwell, Figg, Ernst & Manbeck, P.C.

(57) ABSTRACT

A semi-submersible floating structure for the drilling and production of offshore oil and gas is provided. The semi-submersible floating structure includes a pontoon having a plurality of pontoon sections, an outer edge, and an inner edge, the pontoon sections defining an interior space. The semi-submersible floating structure further includes a plurality of columns extending vertically upward from the pontoon. Each column has an upper section having an upper column width; and a lower section. The lower section has a bottom end coupled to the pontoon and aligned with the outer edge of the pontoon, the bottom end having a lower column width greater than the upper column width, at least part of the bottom end protruding into the interior space. The lower section further has a flared portion between the upper section and the bottom end; the flared portion having a width that varies from the upper column width at the upper section to the lower column width at the bottom end. A pontoon center-to-center distance between central axes of opposing sections of the pontoon is greater than a corresponding column center-to-center distance between central axes of
(Continued)

opposing upper sections of the columns coupled to the opposing sections of the pontoon.

14 Claims, 5 Drawing Sheets

(51) Int. Cl.
*B63B 43/06* (2006.01)
*B63B 43/08* (2006.01)

(52) U.S. Cl.
CPC ..... *B63B 43/08* (2013.01); *B63B 2035/442* (2013.01); *B63B 2211/00* (2013.01)

(58) Field of Classification Search
USPC ..... 114/264, 265
See application file for complete search history.

(56) References Cited

U.S. PATENT DOCUMENTS

| | | | |
|---|---|---|---|
| 2003/0095839 | A1 | 5/2003 | Kristensen |
| 2005/0120935 | A1 | 6/2005 | Wybro |
| 2010/0288178 | A1 | 11/2010 | Mansour |
| 2012/0111256 | A1 | 5/2012 | Xu |
| 2013/0000540 | A1 | 1/2013 | Rijken et al. |
| 2014/0305363 | A1 | 11/2014 | Knecht |
| 2015/0298775 | A1 | 10/2015 | Muehlner et al. |

SEMI-SUBMERSIBLE PLATFORM

CROSS REFERENCE OF RELATED APPLICATION

This application claims the benefit of U.S. Provisional Patent Application Ser. No. 62/269,641, filed Dec. 18, 2015, the disclosure which is incorporated herein by reference in its entirety.

FIELD OF THE INVENTION

The present invention relates generally to a support structure. More particularly, embodiments relate to floating structures, such as semi-submersible platforms, used for offshore oil and gas drilling and production.

BACKGROUND OF THE INVENTION

Floating structures, such as semi-submersible platforms, are used for offshore oil and gas drilling and production. These floating structures can work in water depths or environmental conditions that are inappropriate for other types of platforms. For example, semi-submersible platforms have been used in offshore with water depth from 80 meters to 2400 meters and in rough or mild environmental conditions. One type of floating structure is a conventional semi-submersible hull with a square ring pontoon, which typically has four columns placed at and coupled to the four corners of the pontoon. Variants of this conventional design are known.

Known designs attempt to reduce heave motion of the platform, but have shortcomings. For example, some designs are difficult to fabricate (e.g., because of complicated column shapes or overall height), or require offshore integration with topsides (e.g., because of exceeding quayside crane height and water depth limits). Some designs have an enlarged base about 50% of the draft on the bottom of each column with slim pontoons coupled between the columns to reduce vortex induced motion (VIM); such designs, however, are weak in structure, require additional material (e.g., additional hull steel), and are not cost efficient. Some designs include a column having five or six sides disposed at specific angles to each other, which typically challenges fabrication, has limited access, and is applicable only to marginal or small field developments.

Accordingly, there is a need for a floating structure that is structurally integrated and simple to fabricate, reduces environmental forces, improves platform motions (such as heave, VIM), and enhances product efficiency and competency.

SUMMARY OF THE INVENTION

According to one aspect, a semi-submersible floating structure for drilling and production of offshore oil and gas is provided. The semi-submersible floating structure includes a pontoon having a plurality of pontoon sections, the pontoon having an interior edge and an exterior edge. The semi-submersible floating structure further includes a plurality of columns, each column coupled to the pontoon and extending vertically upward from the pontoon, each column having a lower section and an upper section. The upper section has an upper column width and a bottom portion of the lower section has a lower column width. The lower sections of the plurality of columns are flared outward such that the lower column width is greater than the upper column width. The bottom portion of the lower section is aligned with the pontoon exterior edge. A portion of the lower section of each column protrudes to a space interior to the pontoon interior edge. A pontoon center-to-center distance is greater than a column center-to-center distance, the pontoon center-to-center distance being defined as a distance between central axes of opposing sections of the plurality of pontoon sections and the column center-to-center distance being defined as a distance between central axes of opposing columns of the plurality of columns.

According to another aspect, a semi-submersible floating structure for the drilling and production of offshore oil and gas is provided. The semi-submersible floating structure includes a pontoon having a plurality of pontoon sections, an outer edge, and an inner edge, the pontoon sections defining an interior space. The semi-submersible floating structure further includes a plurality of columns extending vertically upward from the pontoon. Each column has an upper section having an upper column width; and a lower section. The lower section has a bottom end coupled to the pontoon and aligned with the outer edge of the pontoon, the bottom end having a lower column width greater than the upper column width, at least part of the bottom end protruding into the interior space. The lower section further has a flared portion between the upper section and the bottom end; the flared portion having a width that varies from the upper column width at the upper section to the lower column width at the bottom end. A pontoon center-to-center distance between central axes of opposing sections of the pontoon is greater than a corresponding column center-to-center distance between central axes of opposing upper sections of the columns coupled to the opposing sections of the pontoon.

According to some embodiments, of any of the aspects, the lower column width of at least one of the plurality of columns is from 1.2 to 1.5 times the upper column width of the at least one of the plurality of columns. In embodiments, the pontoon center-to-center distance is from 1.1 to 1.3 times the column center-to-center distance. In embodiments, at least one of the plurality of columns further comprises four bulkheads forming a central access space in the at least one of the plurality of columns, wherein two of the four bulkheads are aligned with the pontoon interior edge, and a distance from an interior side of the column lower section and an opposing bulkhead aligned with the pontoon interior edge is from 0.2 to 0.5 times the upper column width.

According to some embodiments, the column center-to-center distance is from 3 to 4 times the upper column width. In embodiments, a design draft of the semi-submersible floating structure is from 0.25 to 0.75 times the column center-to-center distance. In embodiments, the pontoon inner edge intersects at least a portion of an interior side of the bottom end of at least one of the plurality of columns. In embodiments, the pontoon is a ring-type pontoon and the plurality of columns includes first, second, third, and fourth columns disposed at first, second, third, and fourth corners of the pontoon. In embodiments, the lower sections of the plurality of columns are below a design waterline. In embodiments, a design draft of the structure is from about 25 meters to 45 meters.

According to some embodiments, a width of the pontoon is less than or equal to the upper column width of at least one of the plurality of columns. In embodiments, a height of the pontoon is about 0.5 times a width of the pontoon. In embodiments, a displacement of the plurality of columns is from about 1.2 to 2.2 times a displacement of the pontoon. In embodiments, the plurality of columns have a cross-sectional shape of a square with rounded corners. In embodiments, the plurality of columns have a cross-sectional shape of a circle.

BRIEF DESCRIPTION OF THE DRAWINGS

The accompanying drawings, which are incorporated herein and form part of the specification, illustrate various embodiments of the present disclosure and, together with the description, further serve to explain the principles of the disclosure and to enable a person skilled in the pertinent art to make and use the embodiments disclosed herein.

DETAILED DESCRIPTION OF THE INVENTION

Embodiments relate to a ring-type pontoon having a plurality of columns coupled to the pontoon (e.g., placed at each corner of the pontoon) and capable of supporting a deck structure. A column center-to-center distance ($L_{column}$) is taken to be a distance between the central axes of two adjacent columns (e.g., two columns at adjacent corners) (this distance may be constant for a given embodiment or depend on a selection of two columns). A pontoon center-to-center distance ($L_{pontoon}$) is taken to be a distance between the central axes of two opposite pontoon sections, the pontoon sections each being associated with one of the two columns defining $L_{column}$ (this distance may be constant for a given embodiment or depend on a selection of two pontoon sections). In some embodiments, $L_{pontoon}$ is greater than $L_{column}$. For example, $L_{pontoon}$ may be 10% to 30% greater than $L_{column}$.

In some embodiments, one or more of the columns includes a lower section having a flared portion. That is, a width of part of the lower section is greater than a width of an upper portion of the lower section. In some embodiments, the width of the flared portion increases continuously as a function of position along a vertical axis of the lower section of the column. For example, the flared outer side may gently curve outwards, or may be ramp-shaped. In some embodiments, the width at the lower portion of the lower section is from 20% to 50% greater than the width at the upper portion (or, equivalently, a width of the upper section of the column in embodiments where an upper section has constant width meeting with the lower section). In an embodiment having a square or rectangular pontoon with columns placed at each corner, a given column may have two flared outer sides, corresponding to the two outside edges of the pontoon sections meeting at that corner.

In some embodiments, a lower edge of the flared outer side (or sides) of the column is aligned with the outer edge (or edges) of the pontoon. In some embodiments, the inner side (or sides) of the column are straight (that is, not flared), and at least a portion of the inner side (or sides) is intersected by the inner edge (or edges) of the pontoon.

In some embodiments, a draft of the platform is designed to be from 25% to 75% of the column center-to-center distance ($L_{column}$). The platform can be configured as shallow, intermediate, or deep draft depending on environmental and global performance criteria.

Figure 5:
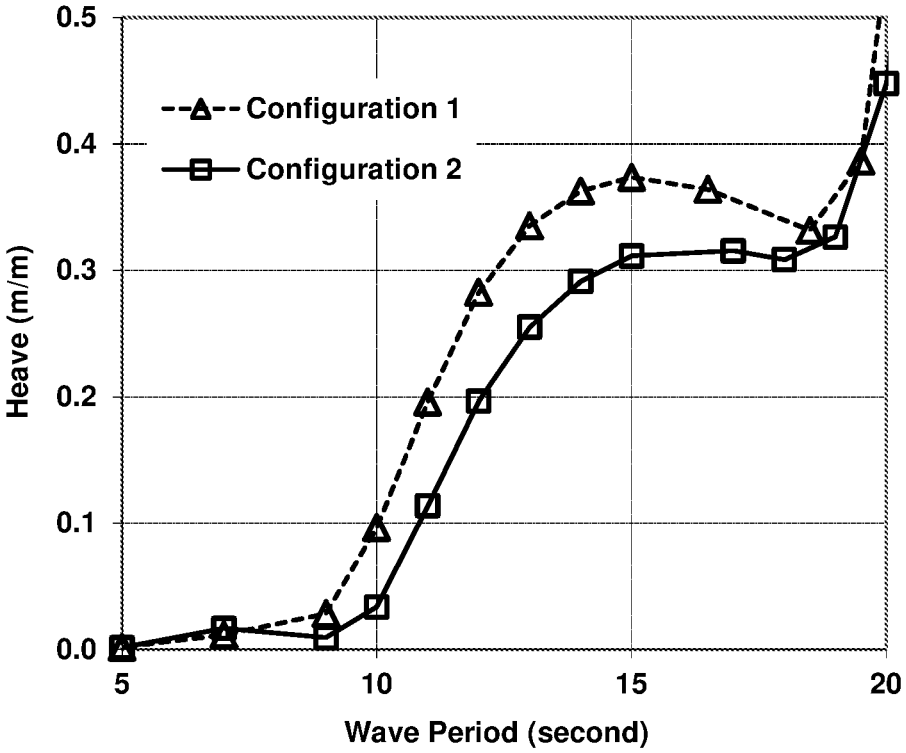
FIG. 5 shows heave motion of a semi-submersible floating structure according to exemplary embodiments of the present invention compared with a conventional semi-submersible design.

Embodiments as described herein may improve motion characteristics of the semi-submersible platform (e.g., heave motion, vortex induced motion (VIM)) (see, for example, FIG. 5 and corresponding description). For example, for a wave having a period from about 5 seconds to about 20 seconds, the vertical wave force on the pontoon (e.g., between the columns) is larger than the force on the columns, and the vertical wave force on the columns is in the opposite direction to the pontoon. In some embodiments, the combination of flared outer sides of the column being aligned with the pontoon exterior edge, and straight inner sides of the column being positioned to be intersected by pontoon interior edge, results in a shift of the phase of vertical wave excitation force onto the pontoon. That is, the wave excitation force on the pontoon is cancelled more than it would be by the columns in a conventional semi-submersible platform. As a result, the combined total environmental force and platform motion in the vertical direction (heave) may be reduced. Moreover, vortices shielded in current from the lower section of the column with a flared outer side are at different phases and do not coincide with the vortices from the upper section of the column, therefore, vortex induced motion may be reduced as well.

Some embodiments significantly enhance global performance of semi-submersible platforms. For example, various aspects facilitate the use of a semi-submersible platform for wet tree applications with steel catenary risers. Various aspects may enable the use of a semi-submersible platform for dry tree applications with top tensioned risers. Embodiments may be applicable for Tension Leg Platforms.

Referring to FIGS. 1-4, an embodiment is shown of a semi-submersible floating structure 10 for the drilling and production of offshore oil and gas. The structure 10 includes a plurality of columns 11 coupled to a pontoon 15. As shown, the pontoon 15 has an outer edge 15*a* and inner edge 15*b*, and is a ring pontoon having four sections 19*a*, 19*b*, 19*c*, and 19*d* arranged generally in a square shape and defining interior space 43. Each section is coupled to and positioned between two adjacent columns. Pontoon 15 may be a single ring structure, or composed of several structures, and may be another shape such as triangular, rectangular, pentagonal, hexagonal, and so forth. The pontoon can be filled with buoyant material such as air and/or ballast such as water.

As shown, there are four columns 11 disposed approximately at each of the four corners of pontoon 15, extending outwardly and upwardly from a top side of the pontoon. There may be more or fewer columns, and they may be disposed at different locations along pontoon 15.

As shown, each column 11 includes an upper section 16 and lower section 12. In some embodiments, upper section 16 may be substantially straight and lower section 12 may include a flared portion, e.g., that flares outwards. For example, at the bottom end 44 (see FIG. 4) of the lower section 12, (in this example, aligned with the outer edge 15*a* of the pontoon 15), a width 22 of bottom end 44 of the lower section is from 1.2 to 1.5 times a width 23 of the upper section. The difference between a lower column width 22 of the bottom end of the lower section and an upper column width 23 of the upper section represents the amount or degree of flaring (e.g., with respect to the height of the flared portion). Such flaring may occur gradually, or may be more rapid. In some embodiments, the height of the flared portion 45 is from about 3 to 5 times the difference between lower column width 22 and upper column width 23.

Each lower section 12 of the columns 11 may be coupled on its bottom end to the pontoon 15 at an equidistant spacing along the perimeter of the pontoon (e.g., at the four corners of the pontoon). In some embodiments, the bottom ends 44 of columns 11 are integrated with pontoon 15 (e.g., such as by welding). The upper sections 16 of columns 11 may have a uniform cross-sectional area, and may be coupled on a top end to a deck structure (not shown). As shown, the cross-sectional area of the columns is generally square, having rounded corners. In some embodiments, the columns may have other cross-sectional areas (e.g., rectangular, circular), and the cross-sectional areas of the upper section 16 and lower section 12 may be different.

Each column 11 may include four bulkheads 17*a*, 17*b*, 17*c*, 17*d* forming a central access space (or central void) 18 inside the column. A bulkhead may be inside the column 11 and aligned with an inner edge of the pontoon 15. For example, in some embodiments the columns 11 may be hollow inside, and bulkheads (e.g., a dividing wall or barrier) may provide structural support. Central access space 18 may connect to a tunnel (not shown) in pontoon 15, and may provide an access for maintenance. As shown, the lower section 12 of each column 11 may include four sides, two sides facing an exterior of the pontoon (12*a*, 12*b*) and two facing an interior (12*c*, 12*d*). Pontoon inner edge 15*b*, for example, forms a corner having orthogonal sides of the pontoon inner edge 15*b* meeting at the corner. As shown, pontoon inner edge 15*b* is positioned to align with two bulkheads 17*a*, 17*b*. That is, one of the bulkheads 17*a*, 17*b* extends along the direction of one of these orthogonal sides, and the other of bulkheads 17*a*, 17*b* extends along the direction of the other of these orthogonal sides. Bulkheads 17*c*, 17*d* are spaced laterally apart from bulkheads 17*a*, 17*b*. An overhang distance 24 is taken to be a distance from an interior side 12*c*, 12*d* of lower section 12 to the opposing bulkhead 17*a*, 17*b*. In some embodiments, this overhang distance 24 represents a region of the column lower section that protrudes to an interior of the pontoon sections. In embodiments, overhang distance 24 is less than the width 23 of the upper section of column 11, and may be from about 0.2 to 0.5 times the width 23.

In some embodiments, a pontoon center-to-center distance 27, taken from the central axis (e.g., 14) of one pontoon section (e.g. 19*d*) to the central axis of an opposite pontoon section (e.g. 19*b*) is greater than a column center-to-center distance 28, taken from a central axis (e.g., 13) of one column to a central axis of an adjacent column. In some embodiments, distance 27 is from about 1.1 to 1.3 times distance 28. In some embodiments, distance 27 may range from about 40 meters to 90 meters.

Figure 1:
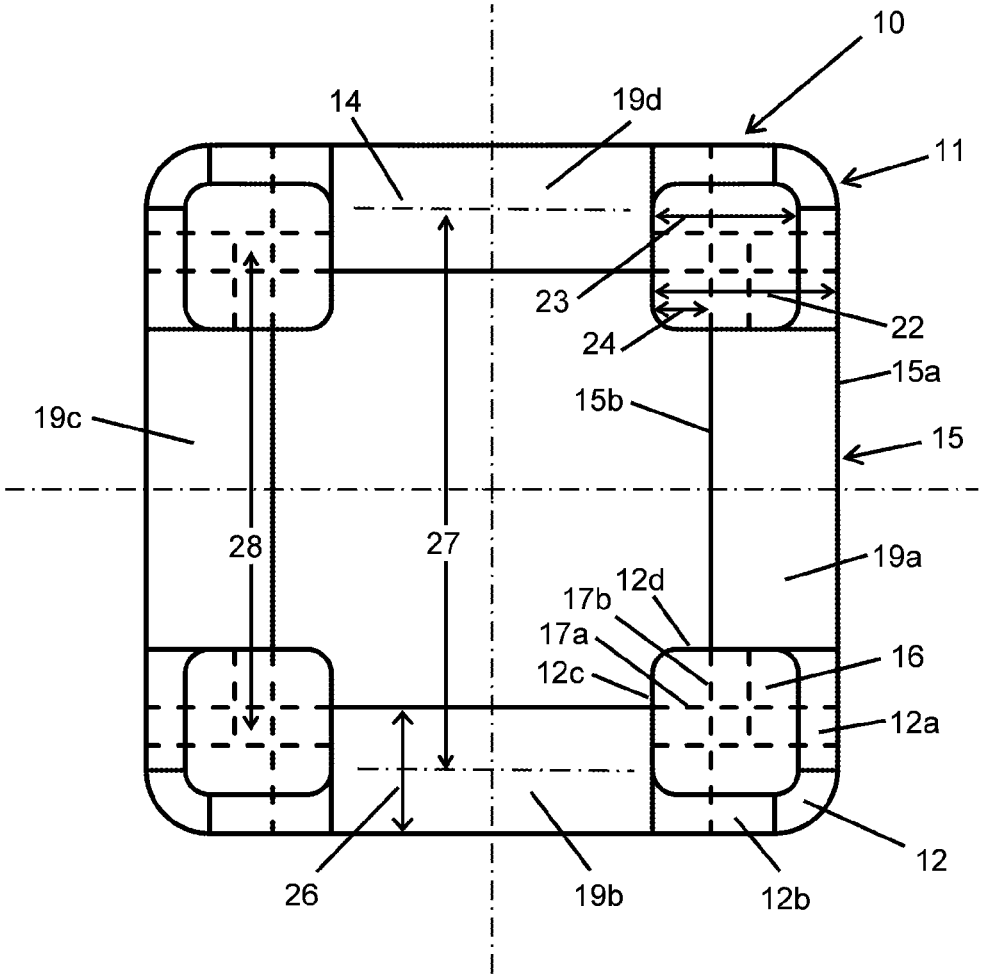
FIG. 1 is a plan view of a semi-submersible floating structure according to exemplary embodiments of the present invention.
Figure 2:
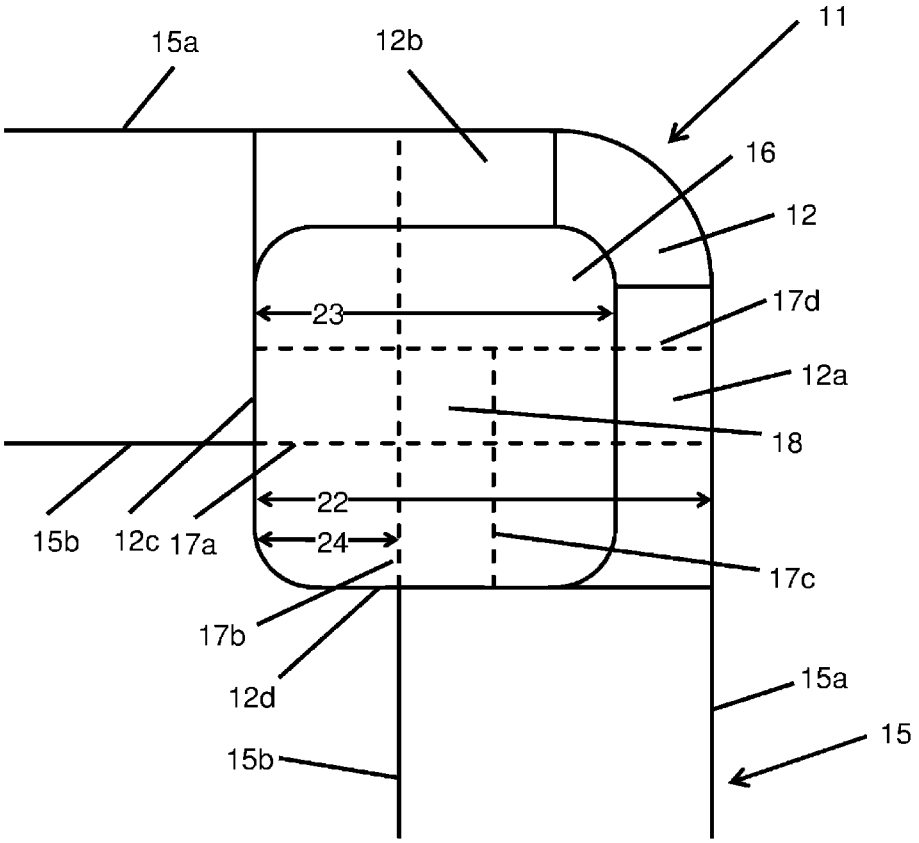
FIG. 2 is a zoomed view of a quadrant of a semi-submersible floating structure according to exemplary embodiments of the present invention.
Figure 3:
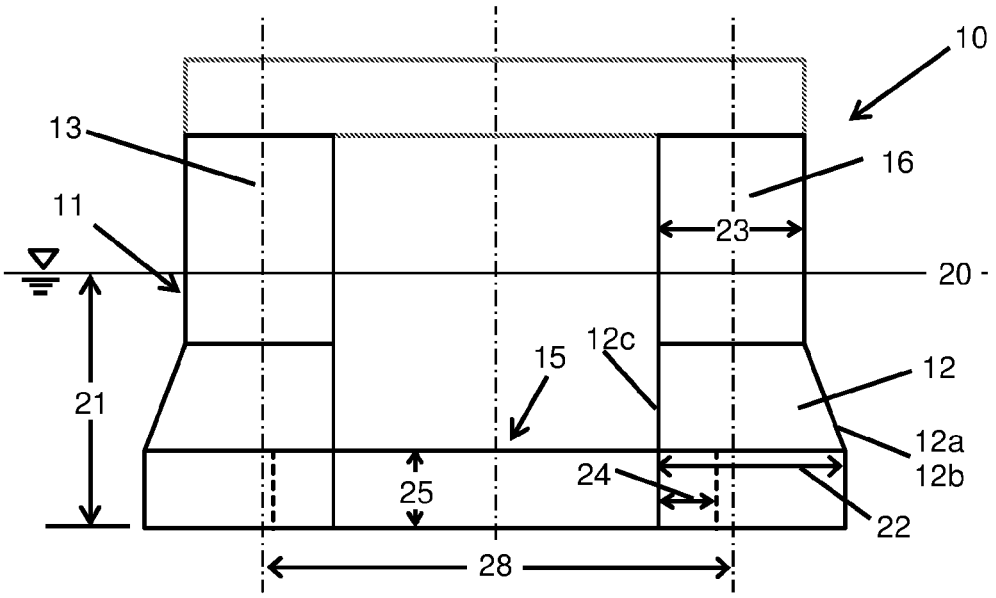
FIG. 3 is an elevation view of a semi-submersible floating structure according to exemplary embodiments of the present invention.
Figure 4:
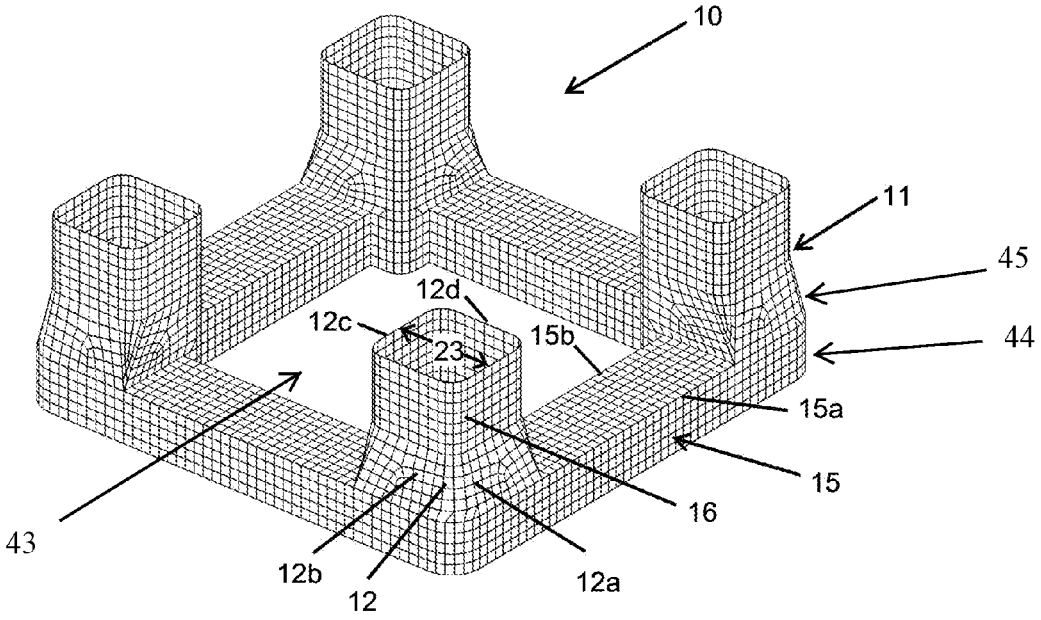
FIG. 4 is a perspective view of a semi-submersible floating structure according to exemplary embodiments of the present invention.

In some embodiments, lower sections 12 and at least part of upper sections 16 of columns 11 are disposed below the waterline 20 (see FIG. 3). The draft 21 (see FIG. 3) of the structure 10 indicates a height of the structure 10 that is below waterline 20. Central axis 13 of column 11 is indicated for reference in calculating distance 28.

In embodiments, the length of the pontoon sections may be substantially greater than the width 23 of the column upper section for a column-stabilized floating structure. The width 23 of the column upper section may in some embodiments range from about 10 meters for a low production rate facility and up to 30 meters for a high production rate facility. The column center-to-center distance 28 may be about 3 to 4 times the width 23 of the column upper section, and the length of the pontoon sections between the columns may be about 2 to 3 times the width 23 of the column upper section. The draft 21 may be from about as shallow as 25 meters in a moderate environment or as deep as 45 meters in a harsh environment. In embodiments, draft 21 may be between 0.25 and 0.75 times the column-to-column distance 28. The pontoon width 26 may be less than or equal to the width 23 of the column upper section. The pontoon height 25 may be about 0.5 times the pontoon width 26. The column displacement may be from about 1.2 to 2.2 times the pontoon displacement.

In embodiments, pontoon 15, pontoon sections 19*a*, 19*b*, 19*c*, and 19*d*, and columns 11, may be made from the same or different types of material (e.g., same or different grades of steel). Pontoon 15 may be fabricated from sheet metal (e.g., steel) having thickness 0.5 inches to 1.5 inches.

In some embodiments, each of the columns 11 is the same as each of the other columns 11 in terms of its dimensions, coupling to the pontoon, and other properties. In other embodiments, one or more of the columns 11 may be different from another one of the columns 11 (e.g., having a different degree of lower section flaring).

Referring now to FIG. 5, a comparison of heave motion of different configurations of a semi-submersible floating structure is provided. A plot of heave motion for a given wave period in seconds is shown for an exemplary disclosed embodiment (Configuration 2) as compared with a conventional semi-submersible design having four columns and a square ring pontoon (Configuration 1). The plot is from computer simulations of Configuration 1 and Configuration 2, and illustrates heave motion in waves with periods from 5 seconds to 20 seconds. For example, for a wave with height of 1 m and period of 15 seconds, the heave motion of Configuration 1 is 0.38 m, and Configuration 2 is 0.31 m, which is an 18% reduction for the exemplary embodiment over a conventional design. For a wave period of 12 seconds, the heave reduction is 31% for the exemplary embodiment over a conventional design.

The draft, column center-to-center distance, pontoon width and pontoon height of Configuration 2 are the same as Configuration 1. The draft is 0.5 times the column center-to-center distance. The upper column width of Configuration 2 is also the same as Configuration 1, but the lower column width of Configuration 2 is 1.2 times its upper column width. Therefore, for Configuration 2, the bottom portion of the column lower section is flared outward to align with the pontoon exterior edge, and overhang at a distance from an interior side of the column lower section and an opposing bulkhead aligned with the pontoon interior edge 0.2 times the upper column width. The column center-to-center distance is 3.5 times the upper column width of Configuration 2 and the column width of Configuration 1. The pontoon center-to-center distance of Configuration 2 is 1.1 times the column center-to-center distance, while the pontoon center-to-center distance of Configuration 1 is the same as its column center-to-center distance. The displacement of the columns is about 1.5 times the displacement of the pontoon for both Configurations.

As shown in FIG. 5, the heave motion for Configuration 2 is generally improved over that of Configuration 1, particularly for wave periods between 7 and 19 seconds, and more particularly for wave periods between 9 and 17 seconds.

While various embodiments have been described above, it should be understood that they have been presented by way of example only, and not limitation. Thus, the breadth and scope of the present disclosure should not be limited by any of the above-described exemplary embodiments. Moreover, any combination of the above-described elements in all possible variations thereof is encompassed by the disclosure unless otherwise indicated herein or otherwise clearly contradicted by context.

The invention claimed is:

1. A semi-submersible floating structure for the drilling and production of offshore oil and gas, the semi-submersible floating structure comprising:

a pontoon having a plurality of pontoon sections, an outer edge, and an inner edge, the pontoon sections defining an interior space; and a plurality of columns extending vertically upward from the pontoon, each column having:

an upper section having an upper column width;

a lower section having:

a bottom end coupled to the pontoon and aligned with the outer edge of the pontoon, the bottom end having a lower column width greater than the upper column width, at least part of the bottom end protruding into the interior space; and a flared portion between the upper section and the bottom end; the flared portion having a width that varies from the upper column width at the upper section to the lower column width at the bottom end;

wherein a pontoon center-to-center distance between central axes of opposing sections of the pontoon is greater than a corresponding column center-to-center distance between central axes of opposing upper sections of the columns coupled to the opposing sections of the pontoon, and wherein at least one of the plurality of columns further comprises four bulkheads forming a central access space in the at least one of the plurality of columns, wherein two of the four bulkheads are aligned with the pontoon interior edge and a distance from an interior side of the column lower section and an opposing bulkhead aligned with the pontoon interior edge is from 0.2 to 0.5 times the upper column width.

2. The semi-submersible floating structure of claim 1, wherein the lower column width of at least one of the plurality of columns is from 1.2 to 1.5 times the upper column width of the at least one of the plurality of columns.

3. The semi-submersible floating structure of claim 1, wherein the pontoon center-to-center distance is from 1.1 to 1.3 times the column center-to-center distance.

4. The semi-submersible floating structure of claim 1, wherein the column center-to-center distance is from 3 to 4 times the upper column width.

5. The semi-submersible floating structure of claim 1, wherein a design draft of the semi-submersible floating structure is from 0.25 to 0.75 times the column center-to-center distance.

6. The semi-submersible floating structure of claim 1, wherein the pontoon inner edge intersects at least a portion of an interior side of the bottom end of at least one of the plurality of columns.

7. The semi-submersible floating structure of claim 1, wherein the pontoon is a ring-type pontoon and wherein the plurality of columns includes first, second, third, and fourth columns disposed at first, second, third, and fourth corners of the pontoon.

8. The semi-submersible floating structure of claim 1, wherein the lower sections of the plurality of columns is below a design waterline.

9. The semi-submersible floating structure of claim 1, wherein a design draft of the structure is from about 25 meters to 45 meters.

10. The semi-submersible floating structure of claim 1, wherein a width of the pontoon is less than or equal to the upper column width of at least one of the plurality of columns.

11. A semi-submersible floating structure for the drilling and production of offshore oil and gas, the semi-submersible floating structure comprising:

a pontoon having a plurality of pontoon sections, an outer edge, and an inner edge, the pontoon sections defining an interior space; and a plurality of columns extending vertically upward from the pontoon, each column having:

an upper section having an upper column width;

a lower section having:

a bottom end coupled to the pontoon and aligned with the outer edge of the pontoon, the bottom end having a lower column width greater than the upper column width, at least part of the bottom end protruding into the interior space; and a flared portion between the upper section and the bottom end; the flared portion having a width that varies from the upper column width at the upper section to the lower column width at the bottom end;

wherein a pontoon center-to-center distance between central axes of opposing sections of the pontoon is greater than a corresponding column center-to-center distance between central axes of opposing upper sections of the columns coupled to the opposing sections of the pontoon, and wherein a height of the pontoon is about 0.5 times a width of the pontoon.

12. A semi-submersible floating structure for the drilling and production of offshore oil and gas, the semi-submersible floating structure comprising:

a pontoon having a plurality of pontoon sections, an outer edge, and an inner edge, the pontoon sections defining an interior space; and a plurality of columns extending vertically upward from the pontoon, each column having:

an upper section having an upper column width;

a lower section having:

a bottom end coupled to the pontoon and aligned with the outer edge of the pontoon, the bottom end having a lower column width greater than the upper column width, at least part of the bottom end protruding into the interior space; and a flared portion between the upper section and the bottom end; the flared portion having a width that varies from the upper column width at the upper section to the lower column width at the bottom end;

wherein a pontoon center-to-center distance between central axes of opposing sections of the pontoon is greater than a corresponding column center-to-center distance between central axes of opposing upper sections of the columns coupled to the opposing sections of the pontoon, and wherein a displacement of the plurality of columns is from about 1.2 to 2.2 times a displacement of the pontoon.

13. The semi-submersible floating structure of claim 1, wherein the plurality of columns have a cross-sectional shape of a square with rounded corners.

14. The semi-submersible floating structure of claim 1, wherein the plurality of columns have a cross-sectional shape of a circle.

* * * * *